US005887231A

United States Patent [19]

Suzuki

[11] Patent Number: 5,887,231

[45] Date of Patent: Mar. 23, 1999

[54] DEVELOPING DEVICE AND IMAGE FORMING APPARATUS

[75] Inventor: Tsuyoshi Suzuki, Nagoya, Japan

[73] Assignee: Brother Kogyo Kabushiki Kaisha, Nagoya, Japan

[21] Appl. No.: 28,362

[22] Filed: Feb. 24, 1998

[30] Foreign Application Priority Data

Feb. 27, 1997 [JP] Japan ..... 9-044464

[51] Int. Cl.[6] ..... G03G 15/08

[52] U.S. Cl. ..... 399/236; 399/281

[58] Field of Search ..... 399/236, 272, 399/281; 430/120

[56] References Cited

U.S. PATENT DOCUMENTS

| | | | |
|---|---|---|---|
| 5,086,728 | 2/1992 | Kinoshita | 399/281 |
| 5,110,705 | 5/1992 | Hosoya et al. | 430/120 |
| 5,655,197 | 8/1997 | Okada et al. | 399/281 |

FOREIGN PATENT DOCUMENTS 7-160108 6/1995 Japan .

8-106213 4/1996 Japan .

*Primary Examiner*—Joan Pendegrass

*Attorney, Agent, or Firm*—Oliff & Berridge, PLC

[57] ABSTRACT

A developing device is provided with: a developing roller for performing an electro-photography on a photosensitive body by using charged toners; a supplying roller for supplying the toners to the developing roller, the supplying roller being pushed against the developing roller so that an outer circumference of the supplying roller be deformed in a radius direction of the supplying roller; and a rotating device for rotating the supplying roller and the developing roller in directions opposite to each other at a contact portion between the supplying roller and the developing roller so that the toners be supplied from the supplying roller to the developing roller. A deformation amount in the radial direction of the supplying roller is not less than 0.5 mm, and a value of dividing an absolute value of a line speed on an outermost circumference of the supplying roller by an absolute value of a line speed on an outermost circumference of the developing roller is less than 0.7 when the line speed on the outermost circumference of the developing roller is set to not less than 70 mm/second.

10 Claims, 5 Drawing Sheets

DEVELOPING DEVICE AND IMAGE FORMING APPARATUS

BACKGROUND OF THE INVENTION

1. Field of the Invention

The present invention relates to a developing device in an image forming apparatus, which supplies electrically-charged toners by a supplying roller to a developing roller and then forms an image by means of an electro-photography by using the toners.

2. Description of the Related Art

There is an image forming apparatus, such as a printer or the like, which forms and records an image onto a record paper by means of a so-called electro-photography by use of a developing device, which is provided with at least a photosensitive drum servicing as a photosensitive body and a developing roller.

In this image forming apparatus, when toners are supplied to the developing roller, the toners are firstly adhered to an outer circumference of a supplying roller. Then, the developing roller and the supplying roller are mutually rotated in the same directions (for example, both are clockwise rotated) under the condition that the supplying roller to which the toners are adhered is pushed against the developing roller, and thereby the toners adhered to the supplying roller are supplied to the developing roller. After that, the toners supplied to the developing roller are adhered to an electric-static latent image on the photosensitive drum, and accordingly the development is performed.

In the developing device in the above mentioned image forming apparatus, the development is performed by using, for example, a toner made of a non-magnet material of a single component. However, in this developing method, the surface of the outer circumference of the supplying roller is made of a sponge material having a predetermined hardness (for example, in a case of an urethane foam roller, a hardness in which a cell number is equal to or more than 80/inch and an ASKER-C hardness ranges between approximate 30 and 20). The supplying roller is deformed so as to be collapsed in a radius direction thereof by pushing the supplying roller against the developing roller made of an elastic member such as rubber or the like. Then, the supplying roller is made in contact with the developing roller at a predetermined area, and accordingly the toners are supplied. Here, the deformation amount in the radius direction of the supplying roller is tentatively referred to as a collapse amount.

The reasons why the toners are supplied by rotating both of the supplying roller and the developing roller in the same directions under the condition that the supplying roller is pushed against the developing roller are described below. That is, as a first reason, when both are rotated in the same directions, the supplying roller and the developing roller are in contact with each other while they are moving in the directions opposite to each other, at the portion (i.e. the nip portion) where they are in contact with each other. However, it is intended to use the friction at that time to thereby charge the toners, which is a first function of the supplying roller. As a second reason, in order to prevent an image in a previous development from having an influence onto a subsequent development, it is intended to scrape off the toners, which are not electrically adhered from the developing roller onto the photosensitive drum in the previous development and thereby remains on the surface of the developing roller, which is a second function of the supplying roller. And as a third reason, it is intended to substantially uniformly supply the toners to the developing roller, which is a third function of the supplying roller.

At this time, in the developing device of the above mentioned image forming apparatus, the collapse amount is typically set to a value less than 0.5 mm. Moreover, a rotational speed of the supplying roller is set such that, in order to sufficiently exhibit the second function of the supplying roller especially among the above mentioned three functions of the supplying roller, the result of dividing an absolute value of a line speed on the outermost circumference of the supplying roller by an absolute value of a line speed on the outermost circumference of the developing roller is approximate 0.7.

Recently, it is extremely desired to make a printing speed faster. However, for this end, it is also necessary to make the developing speed in the developing roller and the photosensitive drum faster. Thus, it is necessary to increase a rotational speed of the developing roller. Hence, it is also necessary to make the rotational speed of the supplying roller faster to thereby maintain the ratio between the above mentioned speeds (approximate 0.7).

However, for example, if increasing the line speed on the outermost circumference in the developing roller equal to or more than 70 mm/second, the abrasion of the developing roller becomes severe because of the friction with the supplying roller. This results in the problem that a life of the developing roller becomes shorter and also a life of the developing device itself becomes short.

SUMMARY OF THE INVENTION

The present invention is proposed in view of the above mentioned problems. It is therefore an object of the present invention to provide a developing device, which life can be extended by reducing the abrasion of a developing roller while performing a clear development, even when performing a fast printing operation, and an image forming apparatus by using the developing device.

The above object of the present invention can be achieved by a developing device provided with: a developing roller for performing an electro-photography on a photosensitive body by using charged toners; a supplying roller for supplying the toners to said developing roller, said supplying roller being pushed against said developing roller so that an outer circumference of said supplying roller be deformed in a radius direction of said supplying roller; and a rotating device for rotating said supplying roller and said developing roller in directions opposite to each other at a contact portion between said supplying roller and said developing roller so that the toners be supplied from said supplying roller to said developing roller, wherein a deformation amount in the radial direction of said supplying roller is not less than 0.5 mm and a value of dividing an absolute value of a line speed on an outermost circumference of said supplying roller by an absolute value of a line speed on an outermost circumference of said developing roller is less than 0.7 when the line speed on the outermost circumference of said developing roller is set to not less than 70 mm/second.

According to the developing device, when setting the line speed on the outermost circumference of the developing roller to 70 mm/second or more, the supplying roller and the developing roller are rotated such that the deformation amount in the radius direction of the supplying roller is equal to or more than 0.5 mm and the value of dividing the absolute value of the line speed on the outermost circumference of the supplying roller by the absolute value of the line speed on the outermost circumference of the developing roller is less than 0.7. Then, the toners are supplied to the developing roller. Accordingly, the development is performed. In this manner, the absolute value of the line speed of the supplying roller is lowered with respect to the absolute value of the line speed of the developing roller, and the deformation amount in the radius direction of the supply roller is increased when the supplying roller becomes in contact with the developing roller in comparison with the case of the aforementioned related art. As a result, while sufficiently ensuring the supplying performance and the charging performance of the toners to the developing roller, it is possible to reduce the abrasion of the developing roller to thereby extend the life of the developing roller.

Consequently, it is possible to extend the life as the developing device and is also possible to perform the clear development for a long term.

In one aspect of the developing device, the toner comprises a non-magnetic material of single component, and said developing roller and said supplying roller charge the toner with a predetermined polarity and a predetermined charge amount by a rotation in contact with each other.

According to this aspect, by use of the toners comprising the non-magnetic material of single component, a clear development can be performed.

In another aspect of the developing device, the outermost circumference of said supplying roller comprises a foaming material whose number of cells is not less than 80/inch.

According to this aspect, by use of the supplying roller whose outermost circumference comprises the foaming material whose cell number is equal to or more than 80/inch, it is possible to obtain the sufficient hardness for the supplying and charging operations of the toners, is also possible to supply the toners in a sufficient amount when developing, and is further possible to uniformly give the predetermined electric charges to the toners.

In this aspect, the foaming material may comprise an urethane foam roller, whose ASKER-C hardness ranges between 30 and 20. Thus, the hardness of the supplying roller is certainly sufficient for the supplying and charging operations of the toners.

In another aspect of the developing device, the developing device is further provided with a blade opposed to said developing roller for regulating a layer thickness of the toners on said developing roller and charging the toners on said developing roller.

According to this aspect, as the developing roller rotates, the layer thickness of the toners on the developing roller can be regulated and the toners on the developing roller can be certainly charged.

The above object of the present invention can be also achieved by an image forming apparatus provided with (a) a photosensitive body, (b) the aforementioned developing device of the present invention, (c) a latent image forming device for forming on said photosensitive body an electrostatic latent image corresponding to an image to be recorded, (d) a transferring device for transferring the toners, which are adhered to said photosensitive body in correspondence with the formed electro-static latent image, onto a record paper on which the image is to be recorded; and (e) a fixing device for fixing the toners transferred on said record paper.

According to the image forming apparatus, the electrostatic latent image is formed on the photosensitive body by the latent image forming device. Then, the latent image is developed by the aforementioned developing device of the present invention. Then, the developed image of the toners on the photosensitive body is transferred onto the record paper by the transferring device. Finally, the transferred image of the toners on the record paper is fixed by the fixing device. Thus, the life of the developing roller is extended, and accordingly the life of the developing device itself can be also extended to thereby record the clear image for a long term.

In one aspect of the image forming apparatus, the toner comprises a non-magnetic material of single component, and said developing roller and said supplying roller charge the toner with a predetermined polarity and a predetermined charge amount by a rotation in contact with each other.

According to this aspect, by use of the toners comprising the non-magnetic material of single component, a clear development can be performed, so that the clear image can be recorded on the record paper for a long term.

In another aspect of the image forming apparatus, the outermost circumference of said supplying roller comprises a foaming material whose number of cells is not less than 80/inch.

According to this aspect, it is possible to obtain the sufficient hardness for the supplying and charging operations of the toners, is also possible to supply the toners in a sufficient amount when developing, and is further possible to uniformly give the predetermined electric charges to the toners, so that the clear image can be recorded on the record paper for a long term.

In this aspect, the foaming material may comprise an urethane foam roller, whose ASKER-C hardness ranges between 30 and 20. Thus, the hardness of the supplying roller is certainly sufficient for the supplying and charging operations of the toners.

In another aspect of the image forming apparatus, the image forming apparatus is further provided with a blade opposed to said developing roller for regulating a layer thickness of the toners on said developing roller and charging the toners on said developing roller.

According to this aspect, the layer thickness of the toners on the developing roller can be regulated and the toners on the developing roller can be certainly charged, so that the clear image can be recorded on the record paper for a long term.

The nature, utility, and further features of this invention will be more clearly apparent from the following detailed description with respect to preferred embodiments of the invention when read in conjunction with the accompanying drawings briefly described below.

DETAILED DESCRIPTION OF THE PREFERRED EMBODIMENT

A preferred embodiment for the present invention is explained with reference to the drawings. The embodiment described below is an embodiment in which the present invention is applied to a so-called laser printer for performing a development by means of the non-magnetic material of single component.

(I) Whole Configuration and Operation

At first, the whole configuration of a laser printer according to the embodiment is explained with reference to FIGS. 1 and 2. Incidentally, FIG. 1 is a perspective view showing the appearance of the laser printer according to the embodiment, and FIG. 2 is a vertical longitudinal section view at the central portion thereof.

Figure 1:
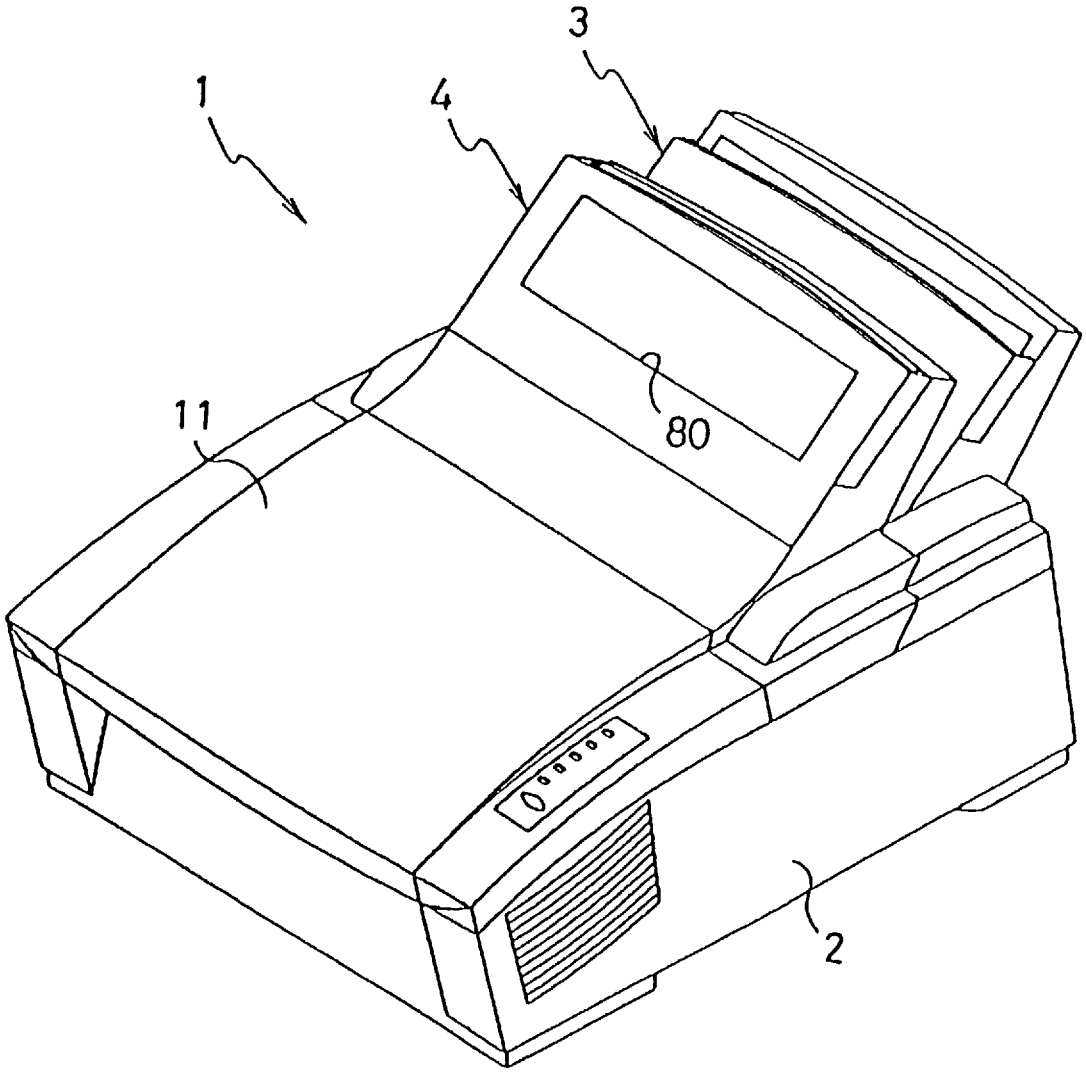
FIG. 1 is a perspective view showing an appearance of a laser printer of an embodiment.
Figure 2:
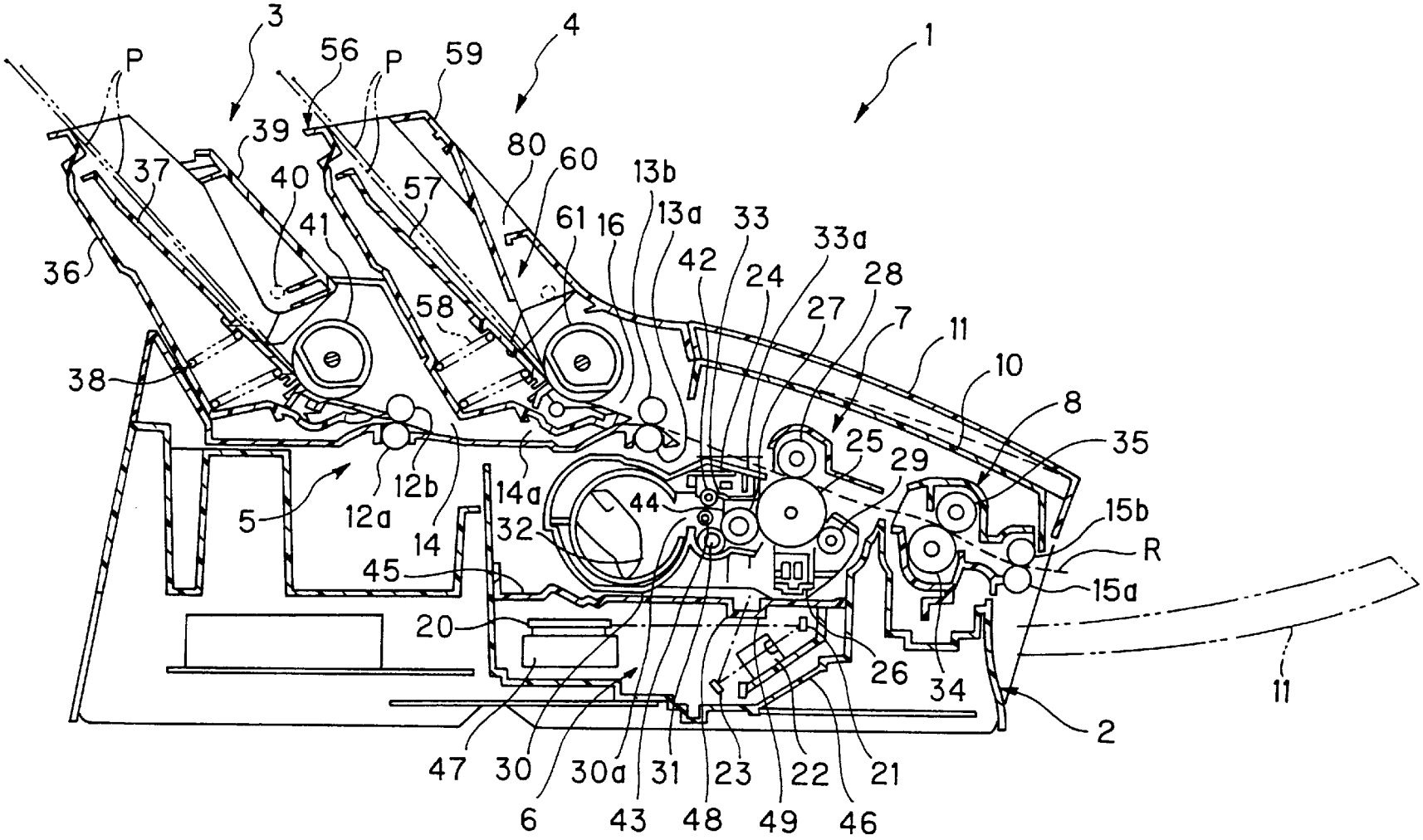
FIG. 2 is a vertical longitudinal section view showing a configuration of the laser printer of the embodiment.

As shown in FIGS. 1 and 2, a laser printer 1 of the embodiment is provided with: a main body case 2; a first paper transporting tray unit 3 and a second paper transporting tray unit 4 which are disposed on the top surface of the rear of the main body case 2; a paper transporting mechanism 5 disposed within the main body case 2; a scanner unit 6 servicing as one example of an latent image forming device; a process unit 7 servicing as one example of a developing device; a fixing unit 8 servicing as one example of a fixing device; and a driving unit (not shown) accommodated in the left end side on the front surface of the main body case 2 to drive the first paper transporting tray unit 3, the second paper transporting tray unit 4, the paper transporting mechanism 5, the process unit 7, the fixing unit 8 and the like.

A top cover 10, by which the inside of the laser printer 1 can be opened, and a paper discharging tray 11 are disposed on the top surface of the front portion of the main body case 2. Among them, the paper discharging tray 11 can be switched from a close position shown by a solid line to an open position shown by a chain line in FIG. 2. When the paper discharging tray 11 is located at the open position, it services as the tray of receiving and accumulating the recorded papers.

In the above mentioned configuration, the scanner unit 6, the process unit 7 and the fixing unit 8 constitutes the print mechanism for actually performing the recording operation.

Among them, the process unit 7 has a cartridge structure in such a way that it contains a photosensitive drum 25 servicing as one example of a photosensitive body, a charger 26, a developing roller 27, a transferring roller 28 servicing as one example of a transferring device, a cleaning roller 29 and the like within a casing 24 and that the process unit 7 can be mounted on and dismounted from a predetermined portion within the main body case 2.

Moreover, the first paper transporting tray unit 3 is fixedly disposed on the top surface in the vicinity of the back end of the main body case 2. The second paper transporting tray unit 4 is detachably disposed on the top surface of the front portion of the first paper transporting tray unit 3 in the main body case 2.

On the other hand, the paper transporting mechanism 5 transports paper P alternatively transported from the first paper transporting tray unit 3 and the second paper transporting tray unit 4 to the process unit 7, and is provided with a pair of transporting rollers 12*a* and 12*b* disposed on the lower end side of the first paper transporting tray unit 3, and a pair of resist rollers 13*a* and 13*b* disposed on the front portion at the lower end of the second paper transporting tray unit 4. Among them, the transporting roller 12*a* is a driving roller, and the transporting roller 12*b* is a driven roller. Further, the resist roller 13*a* is a driving roller, and the resist roller 13*b* is a driven roller.

A paper transporting path 14 from the first paper transporting tray unit 3 to the resist rollers 13*a* and 13*b* includes a bottom side transporting path 14*a* extending along the bottom surface of the second paper transporting tray unit 4. Then, the bottom side transporting path 14*a* becomes in an externally-opened state in the condition that the second paper transporting tray unit 4 is removed from the main body case 2.

Moreover, the paper P transported from the first paper transporting tray unit 3 is transported by the transporting rollers 12*a* and 12*b*, passed on the bottom side transporting path 14*a*, and arrives at the resist rollers 13*a* and 13*b*. After the resist, the paper P is transported to the process unit 7.

On the other hand, the paper P transported from the second paper transporting tray unit 4 arrives at the resist rollers 13*a* and 13*b*. After the resist, the paper P is transported to the process unit 7.

Next, as for the first paper transporting tray unit 3 in detail, the first paper transporting tray unit 3 is provided with: a tray case 36 which can accommodate a plurality of papers P in a backward-raised and inclined state; a paper receiving plate 37 which is disposed at the bottom of the tray case 36 and receives the bottom side of the papers P; a compressed coil spring 38 for forward pushing the paper receiving plate 37; a tray cover 39 which is located opposite to the front side of the paper receiving plate 37 and rotatably disposed in the vicinity of the lower end of the tray case 36 and can be opened and closed by a predetermined angle; a releasing mechanism 40 for releasing the paper receiving plate 37, which functions in conjunction with the opening action of the tray cover 39, backward against the force of the compressed coil spring 38; a paper transporting roller 41; and so on.

Moreover, the second paper transporting tray unit 4 is provided with: a tray case 56 which can accommodate a plurality of papers P in a backward-raised and inclined state; a paper receiving plate 57 which is disposed at the bottom of the tray case 56 and receives the bottom side of the papers P; a compressed coil spring 58 for forward pushing the paper receiving plate 57; a tray cover 59 which is located opposite to the front side of the paper receiving plate 57 and rotatably disposed in the vicinity of the lower end of the tray case 56 and can be opened and closed by a predetermined angle; a releasing mechanism 60 for releasing the paper receiving plate 57, which functions in conjunction with the opening action of the tray cover 59, backward against the force of the compressed coil spring 58; a paper transporting roller 61; and so on. Incidentally, a manually inserting paper port 80 for transporting the paper P by hand is disposed on the front surface of the second paper transporting tray unit 4.

Next, the process unit 7 is actually explained. The process unit 7 is a unit for performing a toner development for a latent image by supplying the toners to an electro-static latent image formed on the surface of the photosensitive drum 25, on the basis of image data to be recorded by a laser optical system which is disposed in the scanner unit 6 and described later.

That is, the process unit 7 is provided with: the photosensitive drum 25; the transferring roller 28 in contact with the top surface of the photosensitive drum 25; the SCOROTORON type charger 26 disposed below the photosensitive drum 25; the developing device having the developing roller 27 disposed upstream from the photosensitive drum 25 in the paper transport direction and a toner supplying roller 31 servicing as one example of a supplying roller; a detachable toner cartridge 30 servicing as one example of a toner retainer disposed further upstream therefrom; the cleaning roller 29 disposed downstream from the photosensitive drum 25 in the paper transport direction; and so on.

A pair of upper and lower augers 42 and 43 are rotatably disposed above the toner supplying roller 31 within the developing chamber in the developing device (hereafter, this "developing chamber" implies the portions including the toner supplying roller 31, the developing roller 27, the upper auger 42, the lower auger 43 described later and the like). The lower auger 43 has a function of carrying the toner, which is supplied into the developing chamber through a toner supply port 30*a* (e.g., a hole formed on a substantial center of the toner cartridge 30 and a hole formed on the casing 24) from the toner cartridge 30, in both end directions of the toner supplying roller 31 above it. The upper auger 42 has a function of carrying the toner from both end sides of the toner supplying roller 31 toward the toner supply port 30*a*. In this way, the toners, which are supplied to the developing chamber side from the toner supply port 30*a* through the lower auger 43 and the upper auger 42, are carried and circulated above the toner supplying roller 31 in both end directions thereof. The toners are supplied while adhered to the toner supplying roller 31 during the carrying and circulating operations. In this embodiment, in order to promote the function of the upper auger 42, an auger partition plate 44 is arranged in a direction parallel to rotational axes of the respective upper auger 42 and lower auger 43 between these upper and lower augers 42 and 43.

On the other hand, a blade 33 is fixed by an L-shaped plate fixing member 33*a* on the bottom surface of the casing 24 above the developing roller 27. This blade 33 charges the toners, which are supplied to the developing roller 27 from the toner supplying roller 31, with a predetermined polarity, and further regulates the layer thickness of a toner layer to a predetermined thickness.

Moreover, an electro-static latent image corresponding to the image data to be recorded by scanning and emitting a laser beam from the scanner unit 6 to the layer charged by the charger 26 is formed on the outer circumference of the photosensitive drum 25. At this time, the toners within the toner cartridge 30 are agitated by an agitator 32 and then exhausted from the toner supply port 30*a*. After that, it is supported on the outer circumference surface of the developing roller 27 through the toner supplying roller 31. Thus, the thickness of the toner layer is regulated by the blade 33. Accordingly, the electro-static latent image formed on the photosensitive drum 25 is actualized by the adhesion of the toners by the developing roller 27, and is then transferred onto a paper P passed between the transferring roller 28 and the photosensitive drum 25. After that, the toners remaining on the photosensitive drum 25 are once electrically kept on the cleaning roller 29. Then, they are electrically returned onto the photosensitive drum 25 at a predetermined timing at which an image is not recorded on the paper P (for example, between a carried paper P and a next paper P, and the like). Furthermore, it is supported on the developing roller 27 and collected into the developing chamber.

Next, the scanner unit 6 is explained.

As shown in FIG. 2, the scanner unit 6 comprises a known laser optical system. This is a unit for performing a scanning operation of the laser optical system on the basis of the inputted image data to be recorded to thereby form the electro-static latent image on the surface of the photosensitive drum 25.

More concretely, the scanner unit 6 is disposed below the process unit 7. A scanner cover 45 is disposed on the top surface of the scanner unit 6. This scanner cover 45 is fixed such that it covers the substantially entire opening on the upstream side in the paper transport direction of a bottom plate 46 of the main body case 2. The scanner unit 6 servicing as one example of an exposing unit is constructed such that a laser emitting section (not shown) such as a semiconductor laser and the like, a scanner motor 47, a polygon mirror 20, a lens 22, reflection mirrors 21 and 23, and so on are disposed on the bottom side of the scanner cover 45. The laser light is passed through a glass plate 49 fitted into an oblong scanner hole 48 formed so as to extend along the rotational axis line of the photosensitive drum 25 by the scanner cover 45, and is emitted onto the outer circumference surface of the photosensitive drum 25. Accordingly, the electro-static latent image is exposure-formed on the outer circumference surface of the photosensitive drum 25 on the basis of the image data. As mentioned above, the toners are supplied through the process unit 7 to the electro-static latent image formed on the photosensitive drum 25 by the laser optical system of the scanner unit 6. Accordingly, the toner development is performed for the electro-static latent image.

Next, the toner image corresponding to the electro-static latent image formed on the photosensitive drum 25 within the process unit 7 is transferred onto the paper P transported to the process unit 7, and is then transported to the fixing unit 8. This fixing unit 8 fixes the toners, which have been transferred onto the paper P, on the paper P by heating. The fixing unit 8 is provided with: a heating roller 34; a pushing roller 35 pushed against the heating roller 34; and a pair of discharging rollers 15*a* and 15*b*, which are disposed downstream from the heating roller 34 and the pushing roller 35, for discharging the paper P outside the main body case 2.

In FIG. 2, a route R of the paper P between the resist rollers 13*a*, 13*b* and the paper discharging tray 11 disposed downstream in the paper transport direction is indicated by a dotted line.

(II) Detailed Configuration and Function of Process Unit

Figure 3:
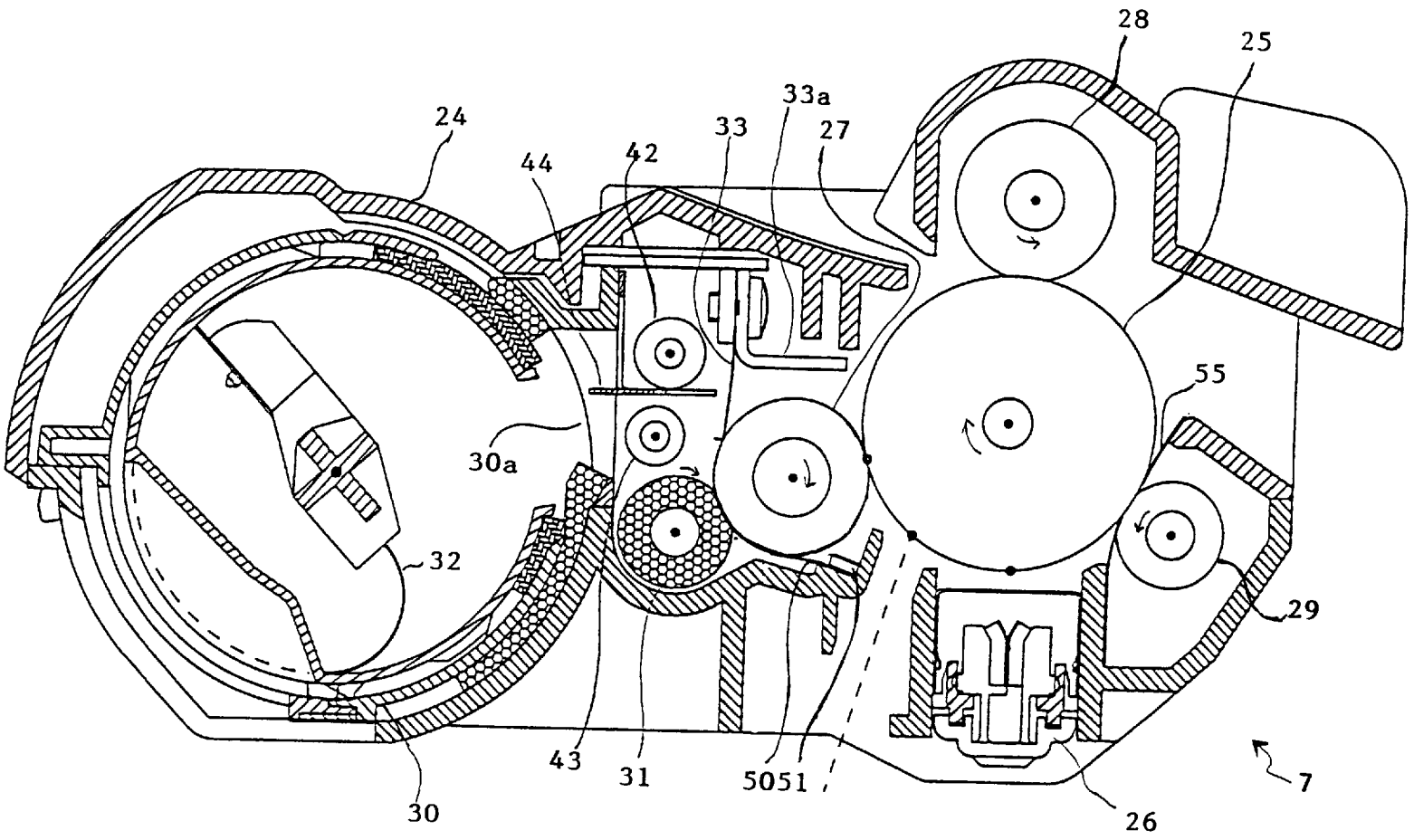
FIG. 3 is a vertical longitudinal section view showing a configuration of a process unit in the laser printer of the embodiment.
Figure 4:
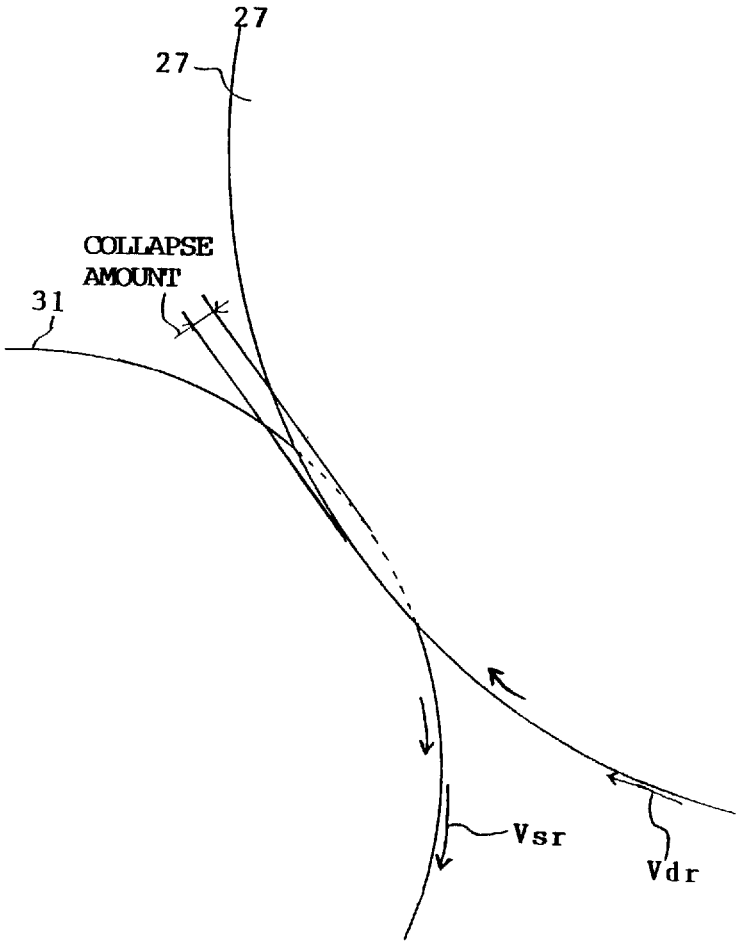
FIG. 4 is a section view showing a contact condition between a developing roller and a supplying roller in a toner supplying operation of the embodiment.

The detailed configuration of the process unit 7 according to the present invention is explained with reference to FIGS. 3 and 4. Incidentally, FIG. 3 is an enlarged vertical longitudinal section view of the process unit 7, and FIG. 4 is a section view explaining the contact condition between the developing roller 27 and the toner supplying roller 31 in the process unit 7.

As mentioned above, when forming the image, the toners are discharged from the toner supply port 30*a* of the toner cartridge 30 while the toners are agitated by the agitator 32, are substantially uniformly divided in the direction of the central axis on the toner supplying roller 31 by the actions of the lower auger 43 and the upper auger 42 and the auger partition plate 44, and are then supplied to the developing roller 27 made of an elastic rubber roller. At this time, the toner supplying roller 31 and the developing roller 27 are rotated in the directions opposite to each other. Moreover, while the contact with the blade 33 causes the toners to be electrically charged, the charged toners are supplied to the developing roller 27.

The supply of the toners performed by the contact between the developing roller 27 and the toner supplying roller 31 is explained in further detail with reference to FIG. 4.

The developing method in the process unit 7 is an inversion developing method by means of an impression developing method using the toners made of a non-magnetic material of single component. Thus, the surface of the developing roller 27 is made of the elastic material such as the rubber and the like. Moreover, the surface of the toner supplying roller 31 is made of, for example, the sponge (for example, the foaming sponge such as the urethane or the like) having the hardness equal to or more than 80/inch for the cell number (of course, this is softer than the elastic material constituting the developing roller 27). Then, when the toners are actually supplied, the toners are supplied by rotating both of the toner supplying roller 31 and the developing roller 27 in the same directions (the clockwise direction in a case of FIG. 4) such that the toner supplying roller 31 is pushed against the developing roller 27 and then the contact portion between them are deformed. Here, the collapse amount on the surface of the toner supplying roller 31 at this time is 0.5 mm or more in the present invention.

As for the ratio between the line speeds in the rotations of the developing roller 27 and the toner supplying roller 31 which are rotated in contact with each other, assuming that the line speed on the outermost circumference of the developing roller 27 (hereafter, referred to as a line speed Vdr) is such a fast speed as to be equal to or more than 70 mm/second, the result of dividing an absolute value of the line speed on the outermost circumference of the toner supplying roller 31 (hereafter, referred to as a line speed Vsr) by an absolute value of the line speed Vdr of the developing roller 27 (hereafter, referred to as a speed ratio "|Vsr|/|Vdr|") is less than 0.7.

The above mentioned collapse amount and the speed ratio are the quantities which have a great influence on the charging operation for the toners performed by the toner supplying roller 31 and the developing roller 27. If the respective quantities are not adequate, the charging operation for the toners is not correctly performed, so that it badly influences the print result as described later.

Next, the toners supplied onto the developing roller 27 are adhered to the photosensitive drum 25. At this time, there is the electro-static latent image, which corresponds to the image data and is formed by the laser light scanning the outer circumference surface of the photosensitive drum 25 charged by the charger 26 (i.e., the electro-static latent image formed by the potential reduction relative to the portion to which the laser light is emitted, with respect to the potential of the photosensitive drum 25 when charged with a predetermined level by the charger 26), on the photosensitive drum 25. Then, the electro-static latent image is actualized by the electrical adhesion of the toners charged with the predetermined polarity to the portion of the electro-static latent image (this toner is charged with the same polarity as the potential of the electro-static latent image by the friction between the toner supplying roller 31 and the developing roller 27).

The image actualized by the adhesion of the toner to the photosensitive drum 25 is transferred onto the paper P transported by the transferring roller 28. After that, the paper P is transported to the fixing unit 8.

Next, the toners remaining on the photosensitive drum 25 are electrically absorbed and tentatively retained by the cleaning roller 29. At this time, a cleaner 55 made of a non-woven fabric cloth and the like is disposed between the photosensitive drum 25 and the cleaning roller 29. Thus, the impurities, such as dusts and paper fibers of the paper P generated in the transferring operation and the like, are not adhered to the cleaning roller 29. Then, the remaining toners adhered to the cleaning roller 29 are returned onto the photosensitive drum 25 by applying between the photosensitive drum 25 and the cleaning roller 29 the electrical field having the direction opposite to that when the remaining toners are adhered to the cleaning roller 29 at a timing when a paper P is not transported.

Then, the remaining toners supported on the photosensitive drum 25 are carried to the developing roller 27 as they are, and are collected into the developing chamber by the developing roller 27 to be re-used.

The formation of the image is consecutively performed by the repetition of the above mentioned operations.

In this embodiment, the reason why the cleaning roller 29 is disposed to tentatively collect the remaining toners is that the photosensitive drum 25 is repeatedly rotated to be consecutively used when recording an image on the sheet of paper P. If the remaining toners adhered to the photosensitive drum 25 are collected by the developing roller 27 as they are, the laser light is interrupted at the portion of the remaining toners. As a result, the image to be recorded on one portion of the paper P remains as an afterimage on a subsequent portion of the paper P.

The process unit 7 of the embodiment has a seal 50, in addition to the above mentioned configuration, as shown in FIG. 3, in such a way that, in order to prevent the toners once collected into the developing chamber from leaking out from the developing chamber, the toners become in contact with the developing roller 27 in the forward direction of the rotation thereof (i.e., the direction in which the contact direction and the rotational direction of the developing roller 27 are identical to each other). The seal 50 is fixed in the lower half of the casing 24 through a board 51. This seal 50 is made of PET (poly-ethylene terephthalate) material and the like under an extremely uniform condition. Thus, due to the seal 50, there is no or little possibility that the remaining toners adhered to the developing roller 27 from the photosensitive drum 25 are cut off due to the seal 50 and are not collected. This seal 50 prevents the remaining toners collected into the developing chamber from leaking out.

EXAMPLES

Next, as for the relation between the collapse amount and the speed ratio of the developing roller 27 to the toner supplying roller 31, the experimental result is explained for the relation with a life of the developing roller 27 in a case that the collapse amount and the speed ratio are variously changed.

In an experiment described below, a parameter typically referred to as a fog is used as a parameter representing a life of the developing roller 27. In a case of using a non-used white record paper, this fog implies a value of subtracting from a reflection density (% as a unit) at a white portion of a record paper in a non-recorded state (a state that it has been never passed through the process unit 7), a reflection density (% as a unit) at a portion which should be white (a portion on which no information is recorded) on the record paper, after it is once passed through the process unit 7 and the recording (printing) operation is performed. For example, when the fog is 2%, if the reflection density at the white portion of the non-recorded record paper is the reflection of 100%, this indicates that the reflection density at the white portion on the record paper after the recording operation is 98%. As this fog value is the higher, the greater is the portion which should be white but has been actually colored (the portion at which the toners are adhered), that is, the greater the developing roller 27 is aged. If this fog becomes 2.5% or more in the usual developing device, the portion which should be white when seen by a human eye may look like the colored state. Hence, it is determined that this value implies the life of the developing roller 27, i.e., the life of the process unit 7 and then the process unit 7 is changed.

A table 1 shows the variation of the fog amount associated with the increase of the number of printed sheets when the collapse amount and the speed ratio are variously changed.

TABLE 1

| Number Of Printed Sheets | Fog (Reflection Density) Parameter A | Parameter B | Parameter C | Parameter D |
|---|---|---|---|---|
| 0 | 2.20 | 2.10 | 2.05 | 1.70 |
| 1000 | 2.30 | 2.15 | 2.10 | 1.80 |
| 2000 | 2.30 | 2.20 | 2.20 | 1.75 |
| 3000 | 2.40 | 2.35 | 2.20 | 1.90 |
| 4000 | 2.55 | 2.40 | 2.20 | 2.00 |
| 5000 | 2.60 | 2.40 | 2.25 | 2.00 |
| 6000 | 2.70 | 2.50 | 2.25 | 2.05 |
| 7000 | 2.90 | 2.70 | 2.30 | 2.20 |
| 8000 | 2.90 | 2.80 | 2.40 | 2.20 |
| 9000 | 3.10 | 3.00 | 2.35 | 2.30 |
| 10000 | 3.50 | 3.40 | 2.50 | 2.40 |

A table 2 shows the values of the collapse amount and the speed ratio set as the parameters A to D in the above table 1.

TABLE 2

| | Collapse Amount | Vsr/Vdr |
|---|---|---|
| Parameter A | 0.40 | 0.48 |
| Parameter B | 0.40 | 0.71 |
| Parameter C | 0.65 | 0.48 |
| Parameter D | 0.65 | 0.71 |

Figure 5:
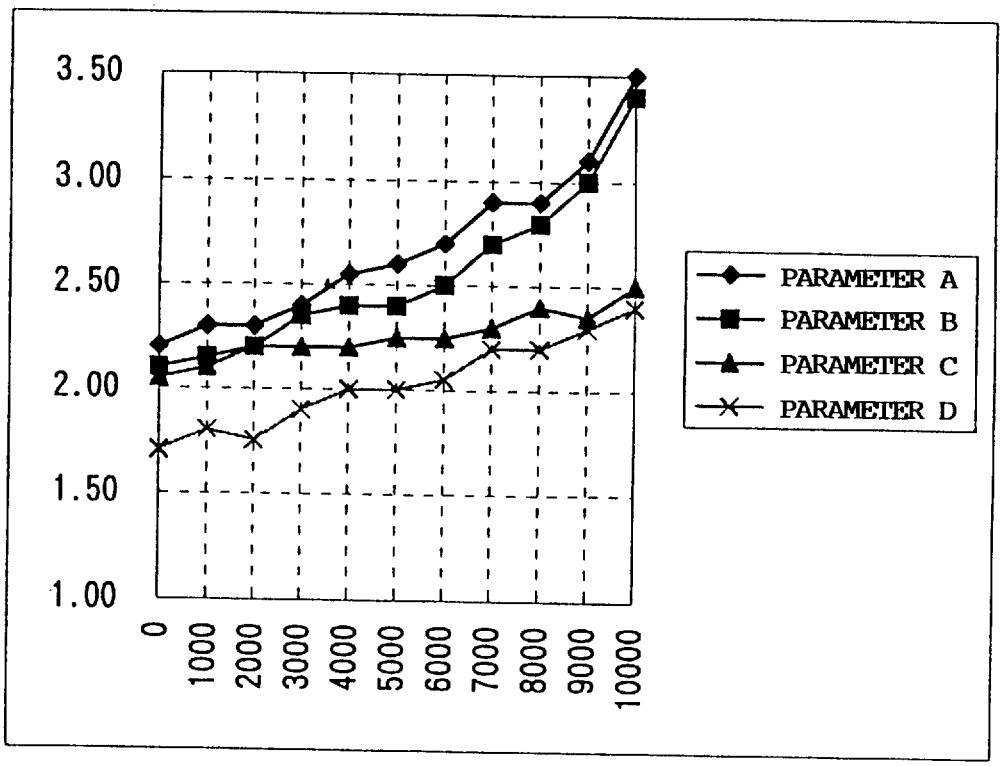
FIG. 5 is a graph showing a relation between the fog amount and the number of printed papers shown in the table 1.

FIG. 5 shows the result of the table 1 with a graph.

As can be seen from the above tables 1 and 2 and FIG. 5, a case in which the life of the developing roller 27 is long is that of the parameter C (the collapse amount is 0.65 mm, and the speed ratio is 0.48) and that of the parameter D (the collapse amount is 0.65 mm, and the speed ratio is 0.71). As for the other parameters, in a case of the parameter A (the collapse amount is 0.40 mm, and the speed ratio is 0.48), it is determined that the printed number of approximately 3500 sheets is the life of the developing roller 27. In a case of the parameter B (the collapse amount is 0.40 mm, and the speed ratio is 0.71), it is determined that the printed number of approximately 6000 sheets is the life of the developing roller 27. From this result, it is recognized that 0.65 mm is proper for the collapse amount.

In a case of comparing the case of the parameter C with that of the parameter D, the case of the parameter D is smaller in fog while the number of the printed sheets is small. However, in a case of the parameter D, if the number of the printed sheets is increased, the fog is suddenly increased. Thus, if determining from the viewpoint whether or not the stability of the printed image continues for a long time (10,000 sheets or more in terms of the number of the printed sheets), it is said that the case of the parameter C is superior to that of the parameter D.

Therefore, it may be determined that only the case of the parameter C has the values adequate for both of the collapse amount and the speed ratio, from the above mentioned results.

The value of the upper limit of the collapse amount is changed on the basis of the radiuses of the developing roller 27 and the toner supplying roller 31. However, the value should be selected in such a way that the life of the developing roller 27 may not become conversely short due to the excessively large collapse amount. More concretely, for example, the value of the upper limit of the collapse amount should be ranging from 1.0 mm to 2.0 mm.

Moreover, the value of the lower limit of the speed ratio is determined on the basis of the fog amount in an initial stage of a printing process as shown in FIG. 5. More concretely, in a case of FIG. 5, it is adequate to set the value of the lower limit of the speed ratio to approximate 0.2.

As explained above, according to the operations of the process unit 7 of this embodiment, when setting the line speed on the outermost circumference of the developing roller 27 to 70 mm/second or more, the toner supplying roller 31 and the developing roller 27 are rotated such that the collapse amount in the toner supplying roller 31 is equal to or more than 0.5 mm and the speed ratio of toner supplying roller 31 to the developing roller 27 is less than 0.7. Then, the toners are supplied to the developing roller 27 by rotating the toner supplying roller 31 and the developing roller 27. Thus, while sufficiently ensuring the charging performance and the supplying performance of the toners to the developing roller 27, it is possible to reduce the abrasion of the developing roller 27 and is also possible to extend the life of the developing roller 27.

The toner is made of a non-magnetic material of single component. The developing roller 27 and the toner supplying roller 31 charge the toners with the predetermined polarity and charging amount by the rotation in contact with each other, which enables the clear development.

The outermost circumference of the toner supplying roller 31 is made of the foaming material whose cell number is equal to or more than 80/inch. Hence, it is possible to obtain the sufficient hardness for the supply of the toners, and is also possible to supply the sufficient toners when developing, and is further possible to uniformly provide the predetermined electric charges.

Since the life of the developing roller 27 is extended, the life of the process unit 7 itself can be extended to thereby record the clear image for a long term.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A developing device comprising:

a developing roller for performing an electro-photography on a photosensitive body by using charged toners;

a supplying roller for supplying the toners to said developing roller, said supplying roller being pushed against said developing roller so that an outer circumference of said supplying roller is deformed in a radius direction of said supplying roller; and a rotating device for rotating said supplying roller and said developing roller in directions opposite to each other at a contact portion between said supplying roller and said developing roller so that the toners be supplied from said supplying roller to said developing roller, wherein a deformation amount in the radial direction of said supplying roller is not less than 0.5 mm and a value of dividing an absolute value of a line speed on an outermost circumference of said supplying roller by an absolute value of a line speed on an outermost circumference of said developing roller is less than 0.7 with the line speed on the outermost circumference of said developing roller set to not less than 70 mm/second.

2. A developing device according to claim 1, wherein the toner comprises a non-magnetic material of single component, and said developing roller and said supplying roller charge the toner with a predetermined polarity and a predetermined charge amount by a rotation in contact with each other.

3. A developing device according to claim 1, wherein the outermost circumference of said supplying roller comprises a foaming material whose number of cells is not less than 80/inch.

4. A developing device according to claim 3, wherein the foaming material comprises an urethane foam roller, whose ASKER-C hardness ranges between 30 and 20.

5. A developing device according to claim 1, further comprising a blade opposed to said developing roller for regulating a layer thickness of the toners on said developing roller and charging the toners on said developing roller.

6. An image forming apparatus comprising (a) a photosensitive body, (b) a developing device comprising:

a developing roller for performing an electrophotography on said photosensitive body by using charged toners;

a supplying roller for supplying the toners to said developing roller, said supplying roller being pushed against said developing roller so that an outer circumference of said supplying roller is deformed in a radius direction of said supplying roller; and a rotating device for rotating said supplying roller and said developing roller in directions opposite to each other at a contact portion between said supplying roller and said developing roller so that the toners be supplied from said supplying roller to said developing roller, wherein a deformation amount in the radial direction of said supplying roller is not less than 0.5 mm and a value of dividing an absolute value of a line speed on an outermost circumference of said supplying roller by an absolute value of a line speed on an outermost circumference of said developing roller is less than 0.7 with the line speed on the outermost circumference of said developing roller is set to not less than 70 mm/second, (c) a latent image forming device for forming on said photosensitive body an electro-static latent image corresponding to an image to be recorded, (d) a transferring device for transferring the toners, which are adhered to said photosensitive body in correspondence with the formed electrostatic latent image, onto a record paper on which the image is to be recorded, and (e) a fixing device for fixing the toners transferred on said record paper.

7. An image forming apparatus according to claim 6, wherein the toner comprises a non-magnetic material of single component, and said developing roller and said supplying roller charge the toner with a predetermined polarity and a predetermined charge amount by a rotation in contact with each other.

8. An image forming apparatus according to claim 6, wherein the outermost circumference of said supplying roller comprises a foaming material whose number of cells is not less than 80/inch.

9. An image forming apparatus according to claim 8, wherein the foaming material comprises an urethane foam roller, whose ASKER-C hardness ranges between 30 and 20.

10. An image forming apparatus according to claim 6, further comprising a blade opposed to said developing roller for regulating a layer thickness of the toners on said developing roller and charging the toners on said developing roller.

* * * * *